US009587484B2

(12) United States Patent
Walton et al.

(10) Patent No.: US 9,587,484 B2
(45) Date of Patent: Mar. 7, 2017

(54) SYSTEMS AND METHODS FOR SURFACE DETECTION OF WELLBORE PROJECTILES

(71) Applicant: Halliburton Energy Services, Inc., Houston, TX (US)

(72) Inventors: Zachary W. Walton, Duncan, OK (US); Michael Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 498 days.

(21) Appl. No.: 13/873,396

(22) Filed: Apr. 30, 2013

(65) Prior Publication Data

US 2014/0318769 A1 Oct. 30, 2014

(51) Int. Cl.
*E21B 47/09* (2012.01)

(52) U.S. Cl.
CPC ..... *E21B 47/09* (2013.01)

(58) Field of Classification Search
CPC ..... E21B 47/09; E21B 47/10; E21B 47/1015; E21B 33/05; E21B 33/04; E21B 33/068; E21B 33/16; G01N 21/17; G01N 21/274; G01N 21/31; G01N 21/55; G01N 21/15; G01N 21/359; G01N 21/552; G01N 21/85; G01N 33/2823; G01N 21/27; G01N 21/3577; G01J 3/0294; G01J 3/0229; G06E 3/001
See application file for complete search history.

(56) References Cited

U.S. PATENT DOCUMENTS

| | | | | |
|---|---|---|---|---|
| 6,198,531 | B1 | 3/2001 | Myrick et al. | |
| 6,529,276 | B1 | 3/2003 | Myrick | |
| 7,920,258 | B2 | 4/2011 | Myrick et al. | |
| 2007/0131416 | A1* | 6/2007 | Odell | E21B 19/06 166/250.1 |
| 2009/0087912 | A1* | 4/2009 | Ramos | C09K 8/032 436/27 |
| 2009/0095465 | A1* | 4/2009 | Vickery | E21B 33/03 166/79.1 |

(Continued)

OTHER PUBLICATIONS

For the American Heritage Dictionary definition: below. (n.d.) American Heritage® Dictionary of the English Language, Fifth Edition. (2011). Retrieved Apr. 7, 2016 from http://www.thefreedictionary.com/below.*

*Primary Examiner* — Wei Wang
(74) *Attorney, Agent, or Firm* — McDermott Will & Emery LLP; John Wustenberg

(57) ABSTRACT

Disclosed are systems and methods for positively identifying wellbore projectiles introduced downhole. One well system includes at least one wellbore projectile configured to be introduced into a flow path associated with a work string arranged within a wellbore and extending from a wellhead installation, at least one optical computing device in optical communication with the flow path and having at least one integrated computational element configured to detect a characteristic of the at least one wellbore projectile and generate a resulting output signal indicative of the characteristic of the at least one wellbore projectile, and a computational system configured to receive the resulting output signal and associate the resulting output signal with a size or configuration of the at least one wellbore projectile.

18 Claims, 2 Drawing Sheets

(56) References Cited

U.S. PATENT DOCUMENTS

| | | | | |
|---|---|---|---|---|
| 2010/0155055 | A1* | 6/2010 | Ash | E21B 34/14<br>166/193 |
| 2010/0245096 | A1* | 9/2010 | Jones | E21B 47/102<br>340/603 |
| 2012/0234534 | A1* | 9/2012 | Hughes | E21B 33/05<br>166/255.1 |
| 2012/0267112 | A1* | 10/2012 | Zhang | C09K 8/516<br>166/308.1 |

* cited by examiner

SYSTEMS AND METHODS FOR SURFACE DETECTION OF WELLBORE PROJECTILES

BACKGROUND

The present disclosure is generally related to wellbore operations and, more particularly, to the detection of wellbore projectiles.

In the oil and gas industry, subterranean formations penetrated by a wellbore are often fractured or otherwise stimulated in order to enhance hydrocarbon production. Fracturing and stimulation operations are typically carried out by strategically isolating various zones of interest (or intervals within a zone of interest) in the wellbore using packers and the like, and then subjecting the isolated zones to a variety of treatment fluids at increased pressures. In a typical fracturing operation for a cased wellbore, the casing cemented within the wellbore is first perforated to allow hydrocarbons within the surrounding subterranean formation to flow into the wellbore. Prior to producing the hydrocarbons, however, treatment fluids are pumped into the wellbore and through the perforations into the formation, which has the effect of opening and/or enlarging drainage channels in the formation, and thereby enhancing the producing ability of the well.

It is possible to stimulate multiple zones during a single stimulation operation by using onsite stimulation fluid pumping equipment. In such applications, several packers are introduced into the wellbore and each packer is strategically located at predetermined intervals configured to isolate adjacent zones of interest. Once the packers are appropriately deployed, a wellbore projectile may be introduced into the wellbore to selectively engage a corresponding downhole tool in order to perform a predetermined action thereon. For example, the wellbore projectile may engage and shift a sleeve to open ports that allow fluid communication into an isolated zone for treatment or stimulation. Once the isolated zone has been properly stimulated, a subsequent wellbore projectile is dropped to interact with another downhole tool, uphole of the previous downhole tool, for stimulation thereabove. This process is repeated until all the desired zones have been stimulated.

The wellbore projectiles are typically sent into the wellbore strategically in a predetermined fashion depending, for example, on their relative size. For instance, the smallest wellbore projectiles are introduced into the wellbore prior to the larger wellbore projectiles, where the smallest wellbore projectile is suitable for interacting with the downhole tool furthest in the well, and the largest wellbore projectile is suitable for interacting with the downhole tool closest to the surface of the well. If the wrong size wellbore projectile is introduced into the wellbore, remedial operations to remove the projectile can be costly and time-consuming. Accordingly, those skilled in the art will readily appreciate that reliably detecting the size and configuration of a wellbore projectile entering the wellbore at the surface would prove advantageous in stimulation operations.

SUMMARY OF THE DISCLOSURE

The present disclosure is generally related to wellbore operations and, more particularly, to the detection of wellbore projectiles.

In some embodiments, a well system is disclosed and may include at least one wellbore projectile configured to be introduced into a flow path associated with a work string arranged within a wellbore, at least one optical computing device in optical communication with the flow path and having at least one integrated computational element configured to detect a characteristic of the at least one wellbore projectile and generate a resulting output signal indicative of the characteristic, and a computational system configured to receive the resulting output signal and associate the resulting output signal with a size or configuration of the at least one wellbore projectile.

In some embodiments, a method of identifying a wellbore projectile is disclosed. The method may include introducing one or more wellbore projectiles into a flow path associated with a work string arranged within a wellbore, monitoring the flow path with at least one optical computing device configured to detect a characteristic of the one or more wellbore projectiles, generating a resulting output signal with the at least one optical computing device, the resulting output signal being indicative of the characteristic of the one or more wellbore projectiles, receiving the resulting output signal with a computational system, and associating the resulting output signal with a size or configuration of the one or more wellbore projectiles.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure is generally related to wellbore operations and, more particularly, to the detection of wellbore projectiles.

The present disclosure provides systems and methods of providing a positive indication of the introduction of wellbore projectiles into a wellbore. Since wellbore projectiles are often introduced into the wellbore strategically based on their respective size, having a positive indication of which wellbore projectiles are introduced at what time may prove advantageous in eliminating the inadvertent drop of the wrong-sized wellbore projectile. The exemplary systems described herein include one or more optical computing devices used to detect characteristics of the wellbore projectiles. When an optical computing device detects a particular characteristic of interest, a resulting output signal is conveyed to a computational system that may be configured to query a database for an associated wellbore projectile corresponding to the detected characteristic of interest. As a result, well operators may be informed as to which wellbore projectile has been introduced into the wellbore. In some embodiments, this may prove advantageous in knowing exactly what size and/or configuration of the wellbore projectile that has been introduced downhole.

Figure 1:
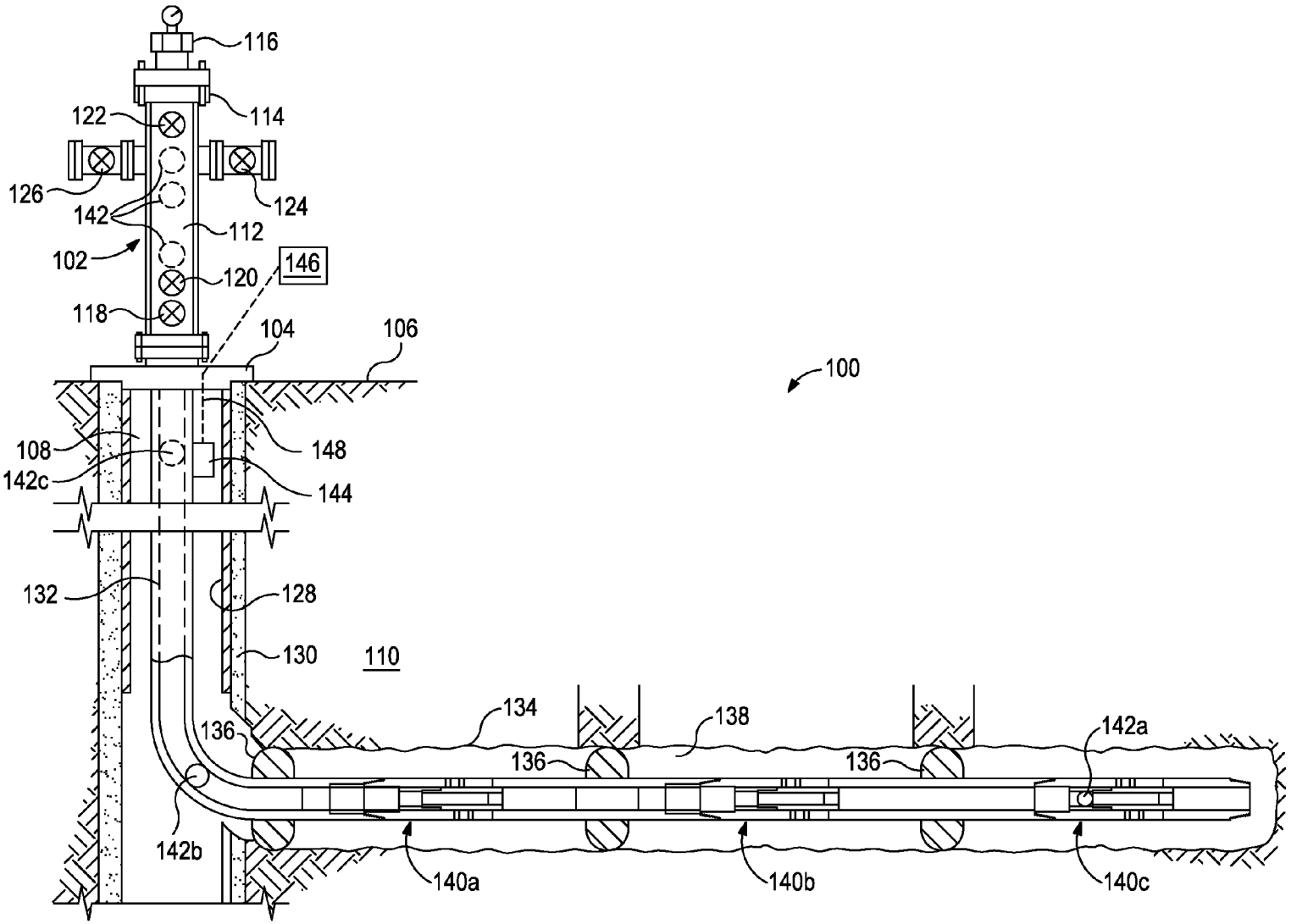
FIG. 1 is a schematic of an exemplary well system that can embody or otherwise employ one or more principles of the present disclosure, according to one or more embodiments.

Referring to FIG. 1, illustrated is an exemplary well system 100 which can embody or otherwise employ one or more principles of the present disclosure, according to one or more embodiments. As illustrated, the well system 100 (hereafter "system 100") may include a wellhead installation 102 operatively coupled to a wellhead 104 arranged at the Earth's surface 106. The wellhead 104 serves to cap and seal a wellbore 108 that extends from the surface 106 into one or more subterranean formations 110. It should be noted that, even though FIG. 1 depicts a land-based wellhead installation 102, it will be appreciated that the embodiments of the present disclosure are equally well suited for subsea wellhead installations 102, without departing from the scope of the disclosure.

The wellhead installation 102 may be any type of installation known to those skilled in the art as being capable of introducing one or more wellbore projectiles 142 into the wellbore 108, as will be discussed in greater detail below. In some embodiments, for example, the wellhead installation 102 may be a Christmas tree, as generally depicted in FIG. 1. The terms "wellhead installation" and "tree" may be used interchangeably herein to refer to the wellhead installation 102. The tree 102 may be coupled to the wellhead 104 using a variety of known techniques, e.g., clamped or bolted connections. Moreover, additional components (not shown), such as a tubing head and/or adapter, may be positioned between the tree 102 and the wellhead 104.

The tree 102 may be of any known type, e.g., horizontal or vertical, or may alternatively be any structure or body that comprises a plurality of valves used to control the introduction and extraction of various items or fluids into and out of the wellbore 108. For example, as mentioned above, the tree 102 may be configured to control the introduction of one or more wellbore projectiles 142 into the wellbore 108. In other embodiments, the tree 102 may be configured to control hydrocarbon production from the wellbore 108 and the surrounding subterranean formations 110.

In general, the tree 102 may include a body 112, an adapter 114, a cap and gauge 116, and a plurality of valves, such as a lower master valve 118, an upper master valve 120, a swab valve 122, a production wing valve 124, and a kill wing valve 126. It will be appreciated that the exact arrangement or number of the valves 118-126 may vary depending upon the particular application. Moreover, those skilled in the art will readily recognize that the illustrative arrangement of the tree 102 and the wellhead 104 should not be considered a limitation of the present invention, but instead many variations of the arrangement may be had without departing from the scope of the disclosure.

As illustrated, the wellbore 108 may extend substantially vertically away from the surface 106. In other embodiments, the wellbore 108 may otherwise deviate at any angle from the surface 106 or portions or substantially all of the wellbore 108 may be vertical, deviated, horizontal, and/or curved. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface 106 of the well and the downhole direction being toward the toe or bottom of the well. Equivalently, the tree 102 may be located at or near the Earth's surface 106, and in the case of subsea or offshore applications and installations, the tree 102 may be located at or near the seafloor, or near the surface of the water.

In an embodiment, the wellbore 108 may be at least partially cased with a casing string 128 secured into position within the wellbore 108 using, for example, cement 130. In other embodiments, the casing string 128 may be only partially cemented within the wellbore 108 or, alternatively, the casing string 128 may be entirely uncemented. A work string 132 may extend within wellbore 108 from the wellhead 104. As used herein, the term "work string" refers to one or more types of connected lengths of tubulars known in the art and may include, but is not limited to, drill pipe, drill string, landing string, completion string, wash pipe, production tubing, coiled tubing, casing, liners, combinations thereof, or the like.

A lower portion of the work string 132 may extend into a branch or lateral portion 134 of the wellbore 108. As illustrated, the lateral portion 134 may be an uncased or "open hole" section of the wellbore 108. It is noted that although FIG. 1 depicts horizontal and vertical portions of the wellbore 108, the principles of the systems and methods disclosed herein may be similarly applicable to or otherwise suitable for use in wholly horizontal or vertical wellbore configurations. Consequently, the horizontal or vertical nature of the wellbore 108 should not be construed as limiting the present disclosure to any particular wellbore 108 configuration.

The work string 132 may be arranged within the lateral portion 134 of the wellbore 108 using one or more packers 136 or other wellbore isolation devices known to those skilled in the art. The packers 136 may be configured to seal off an annulus 138 defined between the work string 132 and the walls of the wellbore 108. As a result, the subterranean formation 110 may be effectively divided into multiple intervals or "pay zones" which may be independently stimulated and/or produced via isolated portions of the annulus 138 defined between adjacent pairs of packers 136. While only three pay zones are shown in FIG. 1, those skilled in the art will readily recognize that any number of pay zones may be defined in the system 100, without departing from the scope of the disclosure.

The system 100 may further include one or more downhole tools 140 (shown as 140*a*, 140*b*, and 140*c*) arranged in, coupled to, or otherwise forming an integral part of the work string 132. As illustrated, at least one downhole tool 140*a-c* may be arranged in the work string 132 in each pay zone, but those skilled in the art will readily appreciate that more than one downhole tool 140*a-c* may be arranged therein, without departing from the scope of the disclosure.

The downhole tools 140*a-c* may include a variety of tools, devices, or machines known to those skilled in the art that may be used in the preparation, stimulation, and production of the subterranean formation 110. In at least one embodiment, for example, one or more of the downhole tools 140*a-c* may include or otherwise be a sliding sleeve assembly able to provide fluid communication between the annulus 138 and the interior of the work string 132. In other embodiments, one or more of the downhole tools 140*a-c* may be a fluid collection device, such as a fluid sampler, or a fluid restriction device, such as a valve, inflow control device, autonomous inflow control device, adjustable inflow control device, or the like. In yet other embodiments, one or more of the downhole tools 140*a-c* may include packers and other wellbore isolation devices, drilling tools, and devices configured to initiate and/or stop data acquisition/transmission. In yet further embodiments, one or more of the downhole tools 140*a-c* may encompass two or more of the above-identified devices, without departing from the scope of the disclosure.

In order to actuate, trigger, or otherwise manipulate the downhole tools 140*a-c*, one or more wellbore projectiles 142 may be introduced into the wellbore 108 and conveyed to the downhole tools 140*a-c* to engage or otherwise act thereon. The wellhead installation 102 may be configured to house the wellbore projectiles 142 until they are to be introduced downhole via the work string 132. In some embodiments, the wellhead installation 102 may be automated such that the wellbore projectiles 142 are introduced into the work string 132 at predetermined intervals or times. In other embodiments, an operator or user at the surface 106 may manipulate one or more of the valves of the wellhead installation 102 in order to introduce a wellbore projectile 142 into the work string 132.

The wellbore projectiles 142 may include, but are not limited to balls (e.g., "frac" balls), darts, wipers, plugs, combinations thereof, or any object known to those skilled in the art that is introduced into the wellbore 108 and not tethered to the surface 106 somehow. In some embodiments, the wellbore projectiles 142 may be pumped from the surface 106 to a predetermined downhole tool 140*a-c*. In other embodiments, one or more of the wellbore projectiles 142 may be conveyed to a predetermined downhole tool 140 using gravitational forces acting on the wellbore projectile 142.

In some embodiments, the wellbore projectiles 142 may be uniquely sized or otherwise configured such that each wellbore projectile 142 is able to interact with a correspondingly sized or configured downhole tool 140*a-c*. For example, in cases where the downhole tool 140*a-c* is a sliding sleeve or the like, the sleeve may have or otherwise define a seat or baffle configured to receive, engage, and/or retain a wellbore projectile 142 of a given size and/or configuration. The baffle may exhibit a reduced diameter in comparison to the diameter of the flow path through the work string 132 and may therefore be configured to engage and generally prevent a correspondingly sized wellbore projectile 142 from advancing any further downhole past the baffle. Once the wellbore projectile 142 is properly seated on the baffle, fluid communication past that point within the work string 132 in the downhole direction is substantially prevented, thereby allowing the work string 132 to be hydraulically pressurized from the surface 106. Upon pressurizing the work string 132, the sleeve may be actuated, such as being forced to move axially downhole to an open configuration and thereby opening one or more flow ports to fluid communication between the annulus 138 and the interior of the work string 132.

As briefly discussed above, smaller wellbore projectiles 142 may be sized to interact with downhole tools 140 situated toward the toe of the wellbore 108, while larger wellbore projectiles 142 may be sized to interact with downhole tools 140 situated closer to the surface 106 of the wellbore 108. Because of their smaller size, the smaller-sized wellbore projectiles 142 may be able to pass through the baffles or seats of downhole tools 140 that are configured to receive larger-sized wellbore projectiles 142.

In the illustrated embodiment, a first wellbore projectile 142*a* has been introduced into the wellbore 108 (i.e., the work string 132) and because of its smaller size or configuration it is able to bypass each of the first and second downhole tools 140*a* and 140*b* and ultimately land on the third downhole tool 140*c*. A second wellbore projectile 142*b* is depicted as being conveyed through the work string 132 and may be sized such that it is able to pass through the first downhole tool 140*a* but to land on or otherwise interact with the second downhole tool 140*b*. A third wellbore projectile 142*c* is also depicted as being conveyed through the work string 132 and may be larger than the first and second wellbore projectiles 142*a,b* and sized such that it is able to land on or otherwise interact with the first downhole tool 140*a*.

As will be readily appreciated by those skilled in the art, it may prove advantageous to strategically introduce the wellbore projectiles 142 into the wellbore 108 (i.e., the work string 132) based on size or configuration such that the downhole tools 140*a-c* are actuated or otherwise triggered in a correspondingly strategic fashion. Those skilled in the art will also readily appreciate the importance of knowing exactly which wellbore projectile 142 is being introduced into the work string 132 since introducing the wrong-sized wellbore projectile 142 may result in costly and time consuming remedial efforts.

According to embodiments of the present disclosure, the system 100 may be configured to provide a user or operator with a positive indication of which wellbore projectile 142 is being introduced into the work string 132 and when this event occurs. To accomplish this, the system 100 may further include at least one optical computing device 144 arranged to be in optical communication with the work string and, more particularly, with a flow path defined within or otherwise associated the work string 132. While only one optical computing device 144 is depicted in FIG. 1, it will be appreciated that any number of optical computing devices 144 may be used, without departing from the scope of the disclosure.

In some embodiments, the optical computing device 144 may be arranged within the wellbore 108 at or near the surface 106, as illustrated. In other embodiments, however, the optical computing device 144 may be arranged above ground at the surface 106, such as at a location on the wellhead installation 102 at or just below where the wellbore projectiles 142 are released from the wellhead installation 102. In yet other embodiments, the optical computing device 144 may be arranged at any other location within the system 100, such as at any point prior to the location of the downhole tools 140*a-c*, so long as it remains in optical communication with the flow path of the work string 132, without departing from the scope of the disclosure.

As illustrated, the optical computing device 144 may be communicably coupled to a computational system 146 or the like via one or more communication lines 148. In some embodiments, the computational system 146 may be arranged at the surface 106, such as at or near the wellbore installation, but in other embodiments the computational system 146 may be arranged at a remote location. The communication line(s) 148 may be any wired or wireless means of telecommunication between the optical computing device 144 and the computational system 146 and may include, but is not limited to, electrical lines, fiber optic lines, radio frequency transmission, electromagnetic telemetry, acoustic telemetry, or any other type of telecommunication means known to those skilled in the art. In at least one embodiment, the optical computing device 144 may form an integral part of the computational system 146.

In exemplary operation, the optical computing device 144 may be configured to continuously monitor the flow path of the work string 132 for the wellbore projectiles 142 as they are introduced downhole. Once the optical computing device 144 detects a wellbore projectile 142 (or a particular characteristic thereof), it may communicate a signal indicating the same to the computational system 146 via the communication lines 148. In some embodiments, a particular or unique characteristic may be associated with each wellbore projectile 142 such that the signal conveyed to the computational system 146 may provide a positive indication that a particular wellbore projectile 142 has been introduced into the work string 132.

The computational system 146 may include a non-transitory, computer readable medium, such as a memory, that may have stored therein data corresponding to each wellbore projectile 142. For example, the size or configuration of each wellbore projectile 142 may be associated with a unique or particular characteristic of interest that may be detected by the optical computing device 144 for each wellbore projectile 142. As a result, each wellbore projectile 142 may have a particular signature associated therewith that may be detected by the optical computing device 144 and recognized by the computational system 146. A well operator may then be able to consult the computational system 146, such as one or more peripheral devices associated therewith (e.g., a monitor, a printer, audible or visual alarms, a computer connection (wired or wireless), etc.) to obtain positive identification of which wellbore projectile 142 is being introduced into the work string 132. In other embodiments, the computational system 146 may be automated such that it automatically confirms that the appropriate wellbore projectile 142 is being introduced downhole.

In the event the wrong wellbore projectile 142 is introduced downhole, as detected by the optical computing device 144 and confirmed by the computational system 146, one or more alerts or signals may be generated by the computational system 146 to warn the well operator of the situation. In such cases, the well operator may undertake one or more remedial operations to correct the inadvertent drop, such as by stopping the pumping of the wellbore projectile 142, adjusting the pumping schedule, or reverse circulating so that the wellbore projectile 142 is returned to the surface 106 for proper removal. In some embodiments, the computational system 146 may be automated and otherwise able to undertake such remedial tasks automatically without user intervention.

A description of the exemplary optical computing device 144 and its exemplary operation is now provided. As used herein, the term "optical computing device" refers to an optical device that is configured to receive an input of electromagnetic radiation associated with a substance and produce an output of electromagnetic radiation from a processing element arranged within the optical computing device. The processing element may be, for example, an integrated computational element (ICE) used in the optical computing device. The electromagnetic radiation that optically interacts with the processing element is changed so as to be readable by a detector, such that an output of the detector can be correlated to a particular characteristic of the substance. The output of electromagnetic radiation from the processing element can be reflected electromagnetic radiation, transmitted electromagnetic radiation, and/or dispersed electromagnetic radiation. In addition, emission and/or scattering of the fluid or a phase thereof, for example via fluorescence, luminescence, Raman, Mie, and/or Raleigh scattering, can also be monitored by the optical computing devices.

As used herein, the term "characteristic" refers to a chemical, mechanical, or physical property or analyte of a substance. Illustrative characteristics of a substance that can be detected or otherwise monitored with the optical computing devices disclosed herein include, but are not limited to, chemical composition (e.g., identity and concentration in total or of individual components), impurity content, pH, viscosity, density, ionic strength, total dissolved solids, salt content, porosity, opacity, bacteria content, color, emissivity, reflectivity, speed, combinations thereof, and the like.

As used herein, the term "substance," or variations thereof, refers to at least a portion of matter or material of interest to be detected by or otherwise evaluated using the optical computing devices described herein. The substance may include the characteristic of interest, as described above. In some embodiments, as discussed above, the substance may be a wellbore projectile 142 (e.g., balls, darts, plugs, etc.). In other embodiments, the substance may be a matter or material of interest applied to the outer surface or region of the wellbore projectile 142, such as a colorant, paint, or any other colored substrate applied to the wellbore projectile 142. The colorant or paint may be a luminescent material that changes the frequency of the incident light, such as fluorescent, phosphorescent, or radioluminescent materials. In some embodiments, the substance may be a tracer substance either applied to the outer surface or region of the wellbore projectile 142 or otherwise forming an integral part thereof. The tracer may be configured to gradually leach from the wellbore projectile 142 upon interaction with a fluid. Exemplary tracers may include, but are not limited to, leachable small molecules or compounds, small molecules not native to subterranean formations, fluorophores, chromophores, radioisotopes, dissolvable materials such as ionic compounds, and the like.

In yet other embodiments, the substance may include any fluid capable of flowing, including particulate solids, liquids, gases (e.g., air, nitrogen, carbon dioxide, argon, helium, methane, ethane, butane, and other hydrocarbon gases, hydrogen sulfide, and combinations thereof), slurries, emulsions, powders, muds, glasses, mixtures, combinations thereof, and may include, but is not limited to, aqueous fluids (e.g., water, brines, etc.), non-aqueous fluids (e.g., organic compounds, hydrocarbons, oil, a refined component of oil, petrochemical products, and the like), acids, surfactants, biocides, bleaches, or any oilfield fluid, chemical, or substance as found in the oil and gas industry.

As used herein, the term "flow path" refers to a route through which a substance is capable of being transported between two points. In some cases, the flow path need not be continuous or otherwise contiguous between the two points. In at least one embodiment, the flow path is the interior of the work string 132, as described above. Other exemplary flow paths may include, but are not limited to, a flowline, a pipeline, a production tubular or tubing, an annulus defined between a wellbore and a pipeline, a subterranean formation, combinations thereof, or the like. It should be noted that the term "flow path" does not necessarily imply that a fluid or substance is flowing therein, rather that a fluid or substance is capable of being transported or otherwise flowable therethrough.

As used herein, the term "electromagnetic radiation" refers to radio waves, microwave radiation, infrared and near-infrared radiation, visible light, ultraviolet light, X-ray radiation and gamma ray radiation.

As used herein, the term "optically interact" or variations thereof refers to the reflection, transmission, scattering, diffraction, or absorption of electromagnetic radiation on, through, or from one or more processing elements (i.e., integrated computational elements) or a substance. Accordingly, optically interacted light refers to electromagnetic radiation that has been reflected, transmitted, scattered, diffracted, or absorbed by, emitted, or re-radiated, for example, using an integrated computational element, but may also apply to interaction with a substance.

Figure 2:
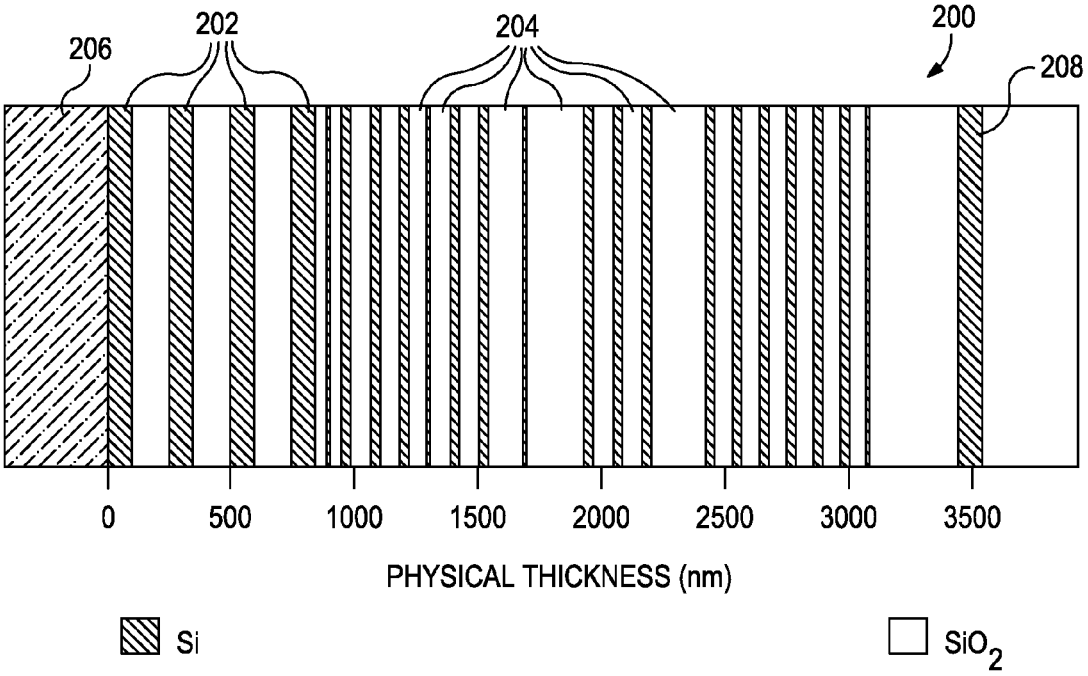
FIG. 2 illustrates an exemplary integrated computation element, according to one or more embodiments.

As mentioned above, the processing element used in the exemplary optical computing device 144 may be an integrated computational element (ICE). In operation, an ICE component is capable of distinguishing electromagnetic radiation related to a characteristic of interest of a substance from electromagnetic radiation related to other components of the substance. Referring to FIG. 2, illustrated is an exemplary ICE 200, according to one or more embodiments. As illustrated, the ICE 200 may include a plurality of alternating layers 202 and 204, such as silicon (Si) and $SiO_2$ (quartz), respectively. In general, these layers 202, 204 consist of materials whose index of refraction is high and low, respectively. Other examples of materials might include niobia and niobium, germanium and germania, MgF, SiO, and other high and low index materials known in the art. The layers 202, 204 may be strategically deposited on an optical substrate 206. In some embodiments, the optical substrate 206 is BK-7 optical glass. In other embodiments, the optical substrate 206 may be another type of optical substrate, such as quartz, sapphire, silicon, germanium, zinc selenide, zinc sulfide, or various plastics such as polycarbonate, polymethylmethacrylate (PMMA), polyvinylchloride (PVC), diamond, ceramics, combinations thereof, and the like.

At the opposite end (e.g., opposite the optical substrate 206 in FIG. 2), the ICE 200 may include a layer 208 that is generally exposed to the environment of the device or installation. The number of layers 202, 204 and the thickness of each layer 202, 204 are determined from the spectral attributes acquired from a spectroscopic analysis of a characteristic of the substance being analyzed using a conventional spectroscopic instrument. It should be understood that the exemplary ICE 200 in FIG. 2 does not in fact represent any particular characteristic of a given substance, but is provided for purposes of illustration only. Consequently, the number of layers 202, 204 and their relative thicknesses, as shown in FIG. 2, bear no correlation to any particular characteristic. Moreover, those skilled in the art will readily recognize that the materials that make up each layer 202, 204 (i.e., Si and $SiO_2$) may vary, depending on the application, cost of materials, and/or applicability of the material to the given substance being analyzed.

In some embodiments, the material of each layer 202, 204 can be doped or two or more materials can be combined in a manner to achieve the desired optical characteristic. In addition to solids, the exemplary ICE 200 may also contain liquids and/or gases, optionally in combination with solids, in order to produce a desired optical characteristic. In the case of gases and liquids, the ICE 200 can contain a corresponding vessel (not shown), which houses the gases or liquids. Exemplary variations of the ICE 200 may also include holographic optical elements, gratings, piezoelectric, light pipe, and/or acousto-optic elements, for example, that can create transmission, reflection, and/or absorptive properties of interest.

The multiple layers 202, 204 exhibit different refractive indices. By properly selecting the materials of the layers 202, 204 and their relative thickness and spacing, the ICE 200 may be configured to selectively pass/reflect/refract predetermined fractions of electromagnetic radiation at different wavelengths. Each wavelength is given a predetermined weighting or loading factor. The thickness and spacing of the layers 202, 204 may be determined using a variety of approximation methods from the spectrum of the characteristic or analyte of interest. These methods may include inverse Fourier transform (IFT) of the optical transmission spectrum and structuring the ICE 200 as the physical representation of the IFT. The approximations convert the IFT into a structure based on known materials with constant refractive indices. Further information regarding the structures and design of exemplary ICE elements is provided in *Applied Optics*, Vol. 35, pp. 5484-5492 (1996) and Vol. 29, pp. 2876-2893 (1990), which are hereby incorporated by reference.

The weightings that the layers 202, 204 of the ICE 200 apply at each wavelength are set to the regression weightings described with respect to a known equation, or data, or spectral signature. When electromagnetic radiation interacts with a substance, unique physical and chemical information about the substance may be encoded in the electromagnetic radiation that is reflected from, transmitted through, or radiated from the substance. This information is often referred to as the spectral "fingerprint" of the substance. The ICE 200 may be configured to perform the dot product of the electromagnetic radiation received by the ICE 200 and the wavelength dependent transmission function of the ICE 200. The wavelength dependent transmission function of the ICE is dependent on the layer material refractive index, the number of layers 202, 204 and the layer thicknesses. The ICE 200 transmission function is then analogous to a desired regression vector derived from the solution to a linear multivariate problem targeting a specific component of the sample being analyzed. As a result, the output light intensity of the ICE 200 is related to the characteristic or analyte of interest.

The optical computing devices employing such an ICE may be capable of extracting the information of the spectral fingerprint of multiple characteristics or analytes within a substance and converting that information into a detectable output regarding the overall properties of the substance. That is, through suitable configurations of the optical computing devices, electromagnetic radiation associated with characteristics or analytes of interest in a substance can be separated from electromagnetic radiation associated with all other components of the substance in order to estimate the properties of the substance in real-time or near real-time. Further details regarding how the exemplary ICE 200 is able to distinguish and process electromagnetic radiation related to the characteristic or analyte of interest are described in U.S. Pat. Nos. 6,198,531; 6,529,276; and 7,920,258, incorporated herein by reference in their entirety.

Figure 3:
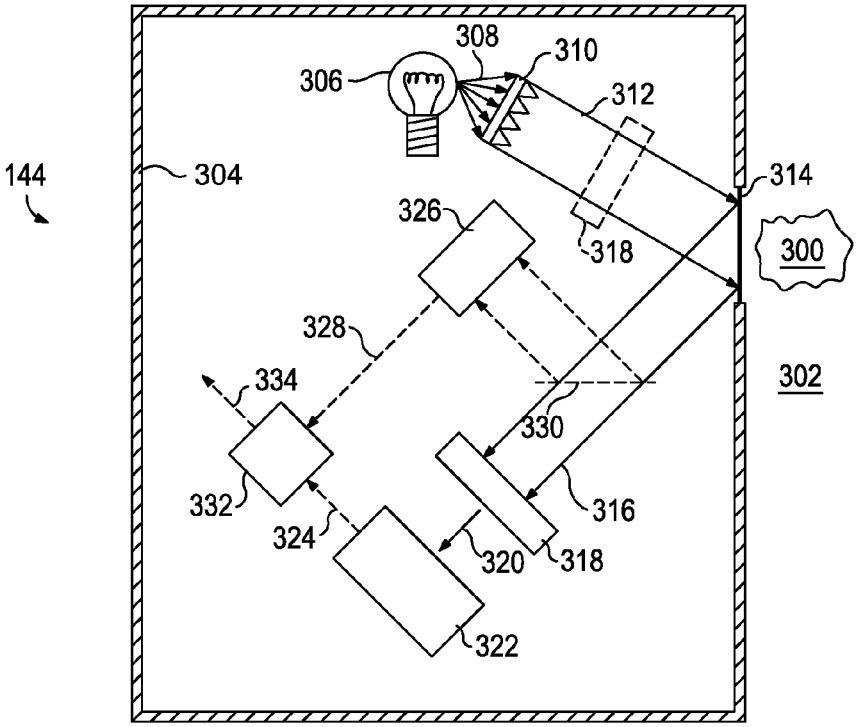
FIG. 3 is a schematic diagram of an exemplary optical computing device, according to one or more embodiments.

Referring now to FIG. 3, with continued reference to FIG. 1, illustrated is an exemplary schematic view of the optical computing device 144, according to one or more embodiments. Those skilled in the art will readily appreciate that the optical computing device 144, and its components described below, are not necessarily drawn to scale nor, strictly speaking, depicted as optically correct as understood by those skilled in optics. Instead, FIG. 3 is merely illustrative in nature and used generally herein in order to supplement understanding of the description of the various exemplary embodiments. Nonetheless, while FIG. 3 may not be optically accurate, the conceptual interpretations depicted therein accurately reflect the exemplary nature of the various embodiments disclosed.

As briefly described above, the optical computing device 144 may be arranged or otherwise configured to determine a particular characteristic of a substance 300 within a flow path 302, such as within the interior of the work string 132. In some embodiments, as described above, the substance 300 may be a wellbore projectile 142 (FIG. 1) or any material applied to the outer surface or region of the wellbore projectile 142, and the optical computing device 144 may be configured to detect a characteristic thereof within the flow path 302.

As illustrated, the optical computing device 144 may be housed within a casing or housing 304 configured to substantially protect the internal components of the device 144 from damage or contamination from the substance 300 or any other substance within the flow path 302. In some embodiments, the housing 304 may operate to mechanically couple the device 144 to the flow path 302 with, for example, mechanical fasteners, brazing or welding techniques, adhesives, magnets, combinations thereof, or the like. The housing 304 may be designed to withstand the pressures that may be experienced downhole and thereby provide a fluid tight seal against external contamination.

The device 144 may include an electromagnetic radiation source 306 configured to emit or otherwise generate electromagnetic radiation 308. The electromagnetic radiation source 306 may be any device capable of emitting or generating electromagnetic radiation, as defined herein. For example, the electromagnetic radiation source 306 may be a light bulb, a light emitting diode (LED), a laser, a blackbody, a photonic crystal, an X-Ray source, combinations thereof, or the like. In some embodiments, a lens 310 may be configured to collect or otherwise receive the electromagnetic radiation 308 and direct a beam 312 of electromagnetic radiation 308 toward a location for sampling or otherwise monitoring the substance 300. The lens 310 may be any type of optical device configured to convey the electromagnetic radiation 308 as desired and may include, for example, a normal lens, a Fresnel lens, a diffractive optical element, a holographic graphical element, a mirror (e.g., a focusing mirror), a type of collimator, or any other electromagnetic radiation transmitting device known to those skilled in art. In other embodiments, the lens 310 may be omitted from the device 144 and the electromagnetic radiation 308 may instead be directed toward the substance 300 directly from the electromagnetic radiation source 306.

In one or more embodiments, the device 144 may also include a sampling window 314 arranged adjacent to or otherwise in contact with the flow path 302 on one side for detection purposes. The sampling window 314 may be made from a variety of transparent, rigid or semi-rigid materials that are configured to allow transmission of the electromagnetic radiation 308 therethrough. For example, the sampling window 314 may be made of, but is not limited to, glasses, plastics, semi-conductors, crystalline materials, polycrystalline materials, hot or cold-pressed powders, combinations thereof, or the like.

After passing through the sampling window 314, the electromagnetic radiation 308 impinges upon and optically interacts with the substance 300 in the flow path 302. As a result, optically interacted radiation 316 is generated by and reflected from the substance 300. Those skilled in the art, however, will readily recognize that alternative variations of the device 144 may allow the optically interacted radiation 316 to be generated by being transmitted, scattered, diffracted, absorbed, emitted, or re-radiated by and/or from the substance 300, without departing from the scope of the disclosure.

The optically interacted radiation 316 generated by the interaction with the substance 300 may be directed to or otherwise be received by an ICE 318 arranged within the device 144. The ICE 318 may be a spectral component substantially similar to the ICE 200 described above with reference to FIG. 2. Accordingly, in operation the ICE 318 may be configured to receive the optically interacted radiation 316 and produce modified electromagnetic radiation 320 corresponding to a particular characteristic of the substance 300. In particular, the modified electromagnetic radiation 320 is electromagnetic radiation that has optically interacted with the ICE 318, whereby an approximate mimicking of the regression vector corresponding to the characteristic of interest is obtained.

It should be noted that, while FIG. 3 depicts the ICE 318 as receiving reflected electromagnetic radiation from the substance 300, the ICE 318 may be arranged at any point along the optical train of the device 144, without departing from the scope of the disclosure. For example, in one or more embodiments, the ICE 318 (as shown in dashed) may be arranged within the optical train prior to the sampling window 314 and equally obtain substantially the same results. In other embodiments, the sampling window 314 may serve a dual purpose as both a transmission window and the ICE 318 (i.e., a spectral component). In yet other embodiments, the ICE 318 may generate the modified electromagnetic radiation 320 through reflection, instead of transmission therethrough.

Moreover, while only one ICE 318 is shown in the device 144, embodiments are contemplated herein which include the use of two or more ICE components in the device 144 in order to monitor more than one characteristic of interest at a time. In such embodiments, various configurations for multiple ICE components can be used, where each ICE component is configured to detect a particular and/or distinct characteristic of interest. In some embodiments, the characteristic can be analyzed sequentially using the multiple ICE components that are provided a single beam of electromagnetic radiation being reflected from or transmitted through the substance 300. In some embodiments, multiple ICE components can be arranged on a rotating disc where the individual ICE components are only exposed to the beam of electromagnetic radiation for a short period of time.

Advantages of this approach can include the ability to analyze multiple characteristics of the substance 300 using a single optical computing device and the opportunity to assay additional characteristics simply by adding additional ICE components to the rotating disc. As a result, a single optical computing device 144 may be able to detect characteristics from multiple substances 300, such as multiple wellbore projectiles 142 being introduced downhole. These optional embodiments employing two or more ICE components are further described in co-pending U.S. patent application Ser. Nos. 13/456,264, 13/456,405, 13/456,302, and 13/456,327, the contents of which are hereby incorporated by reference in their entireties.

In other embodiments, multiple optical computing devices 144 can be used at a single location (or at least in close proximity) along the flow path 302, where each optical computing device 144 contains a unique ICE component that is configured to detect a particular characteristic of interest that can be related to a particular substance 300. As a result, once a particular characteristic is detected by one of the optical computing devices 144, a user may be apprised of which wellbore projectile 142 has been introduced downhole. Each optical computing device 144 can be coupled to a corresponding detector or detector array that is configured to detect and analyze an output of electromagnetic radiation from the respective optical computing device 144. Parallel configurations of optical computing devices 144 can be particularly beneficial for applications that require low power inputs and/or no moving parts.

The modified electromagnetic radiation 320 generated by the ICE 318 may subsequently be conveyed to a detector 322 for quantification of the signal. The detector 322 may be any device capable of detecting electromagnetic radiation, and may be generally characterized as an optical transducer. In some embodiments, the detector 322 may be, but is not limited to, a thermal detector such as a thermopile or photoacoustic detector, a semiconductor detector, a piezoelectric detector, a charge coupled device (CCD) detector, a video or array detector, a split detector, a photon detector (such as a photomultiplier tube), photodiodes, combinations thereof, or the like, or other detectors known to those skilled in the art.

In some embodiments, the detector 322 may be configured to produce an output signal 324 in real-time or near real-time in the form of a voltage (or current) that corresponds to the particular characteristic of interest in the substance 300. The voltage returned by the detector 322 is essentially the dot product of the optical interaction of the optically interacted radiation 316 with the respective ICE 318 as a function of the concentration of the characteristic of interest of the substance 300. As such, the output signal 324 produced by the detector 322 and the concentration of the characteristic of interest in the substance 300 may be related, for example, directly proportional. In other embodiments, however, the relationship may correspond to a polynomial function, an exponential function, a logarithmic function, and/or a combination thereof.

In some embodiments, the device 144 may include a second detector 326, which may be similar to the first detector 322 in that it may be any device capable of detecting electromagnetic radiation. The second detector 326 may be used to detect radiating deviations stemming from the electromagnetic radiation source 306. Undesirable radiating deviations can occur in the intensity of the electromagnetic radiation 308 due to a wide variety of reasons and potentially causing various negative effects on the device 144. These negative effects can be particularly detrimental for measurements taken over a period of time. In some embodiments, radiating deviations can occur as a result of a build-up of film or material on the sampling window 314 which has the effect of reducing the amount and quality of light ultimately reaching the first detector 322. Without proper compensation, such radiating deviations could result in false readings and the output signal 324 would no longer be primarily or accurately related to the characteristic of interest.

To compensate for these types of undesirable effects, the second detector 326 may be configured to generate a compensating signal 328 generally indicative of the radiating deviations of the electromagnetic radiation source 306, and thereby normalize the output signal 324 generated by the first detector 322. As illustrated, the second detector 326 may be configured to receive a portion of the optically interacted radiation 316 via a beam splitter 330 in order to detect the radiating deviations. In other embodiments, however, the second detector 326 may be arranged to receive electromagnetic radiation from any portion of the optical train in the device 144 in order to detect the radiating deviations, without departing from the scope of the disclosure.

In some applications, the output signal 324 and the compensating signal 328 may be conveyed to or otherwise received by a signal processor 332 communicably coupled to both the detectors 322, 326. The signal processor 332 may be a computer including a non-transitory machine-readable medium, and may be configured or otherwise programmed to computationally combine the compensating signal 328 with the output signal 324 in order to normalize the output signal 324 in view of any radiating deviations detected by the second detector 326. In some embodiments, computationally combining the output and compensating signals 324, 328 may entail computing a ratio of the two signals 324, 328. In real-time or near real-time, the signal processor 332 may be configured to determine or otherwise calculate the concentration or magnitude of the characteristic of interest in the substance 300 and generate a resulting output signal 334 which may be, for example, conveyed to the computational system 146 of FIG. 1 for further processing.

Referring again to FIG. 1, with continued reference to FIG. 3, the optical computing device 144 may be configured to continuously monitor the work string 132 (i.e., the flow path defined within the work string 132) for particular characteristics of interest associated with the wellbore projectiles 142. Size or configuration data for some or all of the wellbore projectiles 142 may be stored in the computational system 146 and associated with a unique characteristic of interest corresponding to the particular wellbore projectile 142. As a result, some or all of the wellbore projectiles 142 may be assigned a unique "fingerprint" that may be stored in a memory or library accessible by the computational system 146.

When the optical computing device 144 detects a particular characteristic of interest and conveys the resulting output signal 334 (FIG. 3) to the computational system 146, the computational system 146 may query its fingerprint data for an associated wellbore projectile 142. Once the detected characteristic of interest is positively matched with a stored fingerprint, the computational system 146 may be configured to inform the well operator of which wellbore projectile 142 has been introduced into the work string 132. Accordingly, the well operator may be apprised in real-time of the specific size and/or configuration of the wellbore projectile 142 being introduced downhole.

In some embodiments, for example, the characteristic of interest may be a chemical composition of the wellbore projectile 142, such as the material from which the wellbore projectile 142 is made (e.g., steel, aluminum, rubber, fiber composite, particulate composite, epoxy, etc.). In other embodiments, the characteristic of interest may be a particular color of the wellbore projectile 142, such as a color of the material from which the wellbore projectile 142 is made or a colored substrate applied to the outer surface or region of the wellbore projectile 142. In at least one embodiment, a luminescent material, as described above, may be applied as a substrate to the wellbore projectile 142. In such cases, the frequency of the incident light may be changed upon optical interaction with the luminescent material. Such a frequency shift in the light may prove advantageous in improving the signal-to-noise properties of the detector 322 because the shifted frequency will only be present when the luminescent colorant is present.

In some embodiments, the characteristic of interest may be the emissivity or reflectivity of the wellbore projectile that may be detected by the optical computing device 144. In other embodiments, the characteristic of interest may be a tracer associated with the wellbore projectile 142 that may be detected by the optical computing device 144. Exemplary tracers include leachable small molecule or chemical compounds (e.g., NaCl), fluorophores, chromophores, radioisotopes, dissolvable materials such as ionic compounds, combinations thereof, and the like.

In some embodiments, the characteristic of interest may be a plurality of colors or substrates applied to the outer surface or region of the wellbore projectile 142. In such embodiments, the optical computing device 144 may include a corresponding plurality of ICE components configured to detect each color and/or substrate and thereby verify or otherwise provide positive indication of which wellbore projectile 142 is being monitored. Each wellbore projectile 142 may have disposed thereon a predetermined or unique pattern, design, configuration, or number of colors and/or substrates that may be stored in the computational system 146 as a unique fingerprint corresponding to each wellbore projectile 142. Upon detecting a unique pattern, design, configuration, or number of colors and/or substrates, the optical computing device 144 may convey this signal and the stored fingerprint data may be queried in the computational system 146 for an associated wellbore projectile 142. Once the detected unique pattern, design, configuration, or number of colors and/or substrates is positively matched with a stored fingerprint, the computational system 146 may be configured to inform the well operator of which wellbore projectile 142 has been introduced into the work string 132.

In some embodiments, the optical computing device 144 may be configured to detect a characteristic of interest associated with two or more select wellbore projectiles 142. For example, as mentioned above, in wellbore stimulation and fracturing operations it is not uncommon to introduce several wellbore projectiles 142 into the wellbore 108 (e.g., 30+ wellbore projectiles 142). The smallest wellbore projectile 142 is introduced first, followed by the second smallest, the third smallest, and so on until the largest wellbore projectile 142 is introduced downhole. During the process of dropping the wellbore projectiles 142 it may be advantageous to determine exactly which wellbore projectile 142 in the sequence is being dropped. Accordingly, in some embodiments, for example, every fifth wellbore projectile 142 may be associated with a characteristic of interest detectable by the optical computing device 144. As a result, the well operator may be apprised in real-time of when the 5th, the 10th, the 15th, etc. wellbore projectile 142 has been introduced downhole.

In some embodiments, the optical computing device 144 may be configured to detect a characteristic of interest associated with a wellbore projectile 142 as the wellbore projectile 142 is produced or otherwise returned to the surface 106 from downhole. For example, wellbore projectiles 142 may have been conveyed to various locations within the wellbore 108, including one or more lateral wellbores (not shown). Monitoring the wellbore 108 for the return of wellbore projectiles 142 may prove advantageous in determining which wellbore projectiles have returned and which remain outstanding within the wellbore 108. Such an application may prove especially advantageous in offshore multilateral hydraulic fracturing applications.

It is recognized that the various embodiments herein directed to computer control and/or artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any non-transitory medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A well system, comprising:

at least one wellbore projectile conveyable into a flow path defined by a work string arranged within a wellbore, wherein the at least one wellbore projectile is housed within a Christmas tree coupled to a wellhead and released into the flow path by actuating a valve of the Christmas tree;

at least one optical computing device positioned within the wellbore below the Christmas tree and coupled to the work string, the at least one optical computing device being in optical communication with the flow path and including:

an electromagnetic radiation source that emits electromagnetic radiation to optically interact with the at least one wellbore projectile and an integrated computational element and thereby generate modified electromagnetic radiation;

a first detector arranged to receive the modified electromagnetic radiation and generate an output signal corresponding to a characteristic of the at least one wellbore projectile;

a second detector arranged to detect radiating deviations of the electromagnetic radiation source and generate a compensating signal; and a signal processor that receives and computationally combines the output and compensating signals to generate a resulting output signal; and a computational system configured to receive the resulting output signal and associate the resulting output signal with a size or configuration of the at least one wellbore projectile.

2. The well system of claim 1, wherein the wellbore projectile comprises at least one of a ball, a dart, a wiper, and a plug.

3. The well system of claim 1, wherein the characteristic of the at least one wellbore projectile is at least one of a chemical composition, pH, density, ionic strength, porosity, opacity, bacteria content, color, emissivity, reflectivity, and speed of the at least one wellbore projectile.

4. The well system of claim 1, wherein the characteristic of the at least one wellbore projectile corresponds to a colored substrate or a tracer substance applied to an outer region of the at least one wellbore projectile.

5. The well system of claim 4, wherein the tracer substance is at least one of leachable small molecules or compounds, small molecules not native to subterranean formations, fluorophores, chromophores, radioisotopes, dissolvable materials and compounds, and combinations thereof.

6. The well system of claim 1, wherein the characteristic of the at least one wellbore projectile corresponds to a predetermined or unique pattern, design, configuration, or number of colors and/or substrates applied to an outer region of the at least one wellbore projectile.

7. The well system of claim 1, wherein the computational system comprises a memory configured to store the size or configuration of the at least one wellbore projectile.

8. The well system of claim 1, wherein the characteristic consists of at least one of a plurality of colors and a plurality of substrates applied to an outer surface of the at least one wellbore projectile and the at least one integrated computational element comprises a corresponding plurality of integrated computational elements, and wherein each integrated computational element is configured to detect a corresponding one of the plurality of colors or plurality of substrates.

9. The well system of claim 1, wherein the at least one optical computing device comprises at least first and second optical computing devices arranged in optical communication with the flow path, each of the first and second optical computing devices having at least one integrated computational element configured to detect the characteristic of the at least one wellbore projectile and generate a corresponding resulting output signal to be sent to the computational system.

10. A method of identifying a wellbore projectile, comprising:

actuating a valve of a Christmas tree that houses one or more wellbore projectiles and thereby introducing the one or more wellbore projectiles into a flow path associated with a work string arranged within a wellbore;

monitoring the flow path with an optical computing device positioned within the wellbore below the Christmas tree and coupled to the work string, wherein monitoring the flow path with the optical computing device includes:

optically interacting electromagnetic radiation emitted from an electromagnetic radiation source with the one or more wellbore projectiles and an integrated computational element and thereby generating modified electromagnetic radiation;

generating an output signal corresponding to a characteristic of the one or more wellbore projectiles with a first detector arranged to receive the modified electromagnetic radiation;

generating a compensating signal with a second detector arranged to detect radiating deviations of the electromagnetic radiation source; and receiving and computationally combining the output and compensating signals with a signal processor and thereby generating a resulting output signal indicative of the characteristic of the one or more wellbore projectiles;

receiving the resulting output signal with a computational system; and associating the resulting output signal with a size or configuration of the one or more wellbore projectiles.

11. The method of claim 10, wherein the at least one integrated computational element comprises several integrated computational elements, the method further comprising:

optically interacting each of the several integrated computational elements with the one or more wellbore projectiles; and detecting with each of the several integrated computational element the characteristic of the one or more wellbore projectiles.

12. The method of claim 10, wherein the characteristic of the one or more wellbore projectiles is at least one of a chemical composition, pH, density, ionic strength, porosity, opacity, bacteria content, color, emissivity, reflectivity, and speed.

13. The method of claim 10, wherein the characteristic of the one or more wellbore projectiles corresponds to a colored substrate or a tracer substance applied to the outer surface of the one or more wellbore projectile.

14. The method of claim 10, further comprising:

storing data corresponding to the size or configuration of each of the one or more wellbore projectiles in a memory arranged in the computational system; and accessing the memory to associate the resulting output signal with the size or configuration corresponding to each of the one or more wellbore projectiles.

15. The method of claim 14, further comprising informing a well operator of the size or configuration of the one or more wellbore projectiles.

16. The method of claim 10, further comprising conveying an alert to a well operator when a wrong size or configuration of the one or more wellbore projectiles has been introduced into the flow path.

17. The method of claim 16, further comprising undertaking one or more remedial operations to correct the wrong size or configuration of the one or more wellbore projectiles being introduced into the flow path.

18. The method of claim 10, wherein monitoring the flow path with the optical computing device comprises:

monitoring the flow path with a first optical computing device and a second optical computing device, each of the first and second optical computing devices having at least one integrated computational element arranged therein;

optically interacting the at least one integrated computational element of each of the first and second optical computing devices with the one or more wellbore projectiles; and detecting the characteristic of the one or more wellbore projectiles with each integrated computational element.

* * * * *